United States Patent [19]

Bergeron

[11] Patent Number: 4,836,154

[45] Date of Patent: Jun. 6, 1989

[54] POPPET VALVE ASSEMBLY WITH APERTURES

[76] Inventor: Charles W. Bergeron, 3841 Crawford Ave., Coconut Grove, Fla. 33133

[21] Appl. No.: 86,604

[22] Filed: Aug. 18, 1987

[51] Int. Cl.[4] ..... F01L 1/28

[52] U.S. Cl. ..... 123/79 C

[58] Field of Search ..... 123/79 C

[56] References Cited

U.S. PATENT DOCUMENTS 4,094,277 6/1978 Goto et al. ..... 123/79 C
4,649,872 3/1987 Solheim ..... 123/79 C

FOREIGN PATENT DOCUMENTS

WO84/00401 2/1984 PCT Int'l Appl. ..... 123/188 GC

*Primary Examiner*—Charles J. Myhre
*Assistant Examiner*—David A. Okonsky
*Attorney, Agent, or Firm*—Barry L. Haley

[57] ABSTRACT

An intake or exhaust valve assembly for use in a four cycle internal combustion engine including a primary poppet valve, said primary poppet valve having at least one aperture disposed through its valve body and a secondary poppet valve body mounted to seal when engaged to the primary valve body, said secondary valve body having at least one aperture and a biasing means for moving the secondary valve body away from the primary valve body during the initial opening process when the primary valve is accelerating to its opened position. In the closed position of an intake port, the primary valve apertures are not aligned with the secondary valve apertures thus forming a sealed closure across the port. During the opening process of the intake cycle the biasing means moves the secondary valve body away from the primary valve body, thereby permitting intake charge to flow through the apertures disposed in the primary and the secondary valve bodies. In continuation during the final travel of the primary valve to the full opening said secondary valve is unseated by a stop causing the secondary valve to travel in unison to the maximum valve lift position, greatly increasing the volumetric efficiency of the engine.

4 Claims, 2 Drawing Sheets

POPPET VALVE ASSEMBLY WITH APERTURES

BACKGROUND OF THE INVENTION

1. Field of the Invention

This invention relates to an intake valve assembly for use in a four cycle internal combustion engine, and specifically to an improved poppet valve assembly that utilizes two poppet valve bodies for each port, each of said poppet valve bodies having one or more apertures. When the valve is closed, the valve bodies are sealed in contact against each other with the apertures in each body non-aligned When the valve is open, the valve bodies are separated permitting intake charge to flow through the apertures in each valve body. The purpose of the invention is to quantatively increase the available port opening area of an intake port for optimum charge flow into the combustion chamber resulting in greater volumetric efficiency. With the present invention valve lift distance can be less than the lift distance used with a conventional poppet valve.

2. Description of the Prior Art

A poppet valve has long been used as an intake or exhaust valve in four cycle combustion engines. As conventionally used, a single poppet valve opens or seals closed an intake or exhaust port during predetermined periods of engine operation. One of the inherent problems with the use of a poppet valve is its geometric shape and its location with the respect to a port opening. The available window or opening area that receives the charge flow when the valve is in the open position is dramatically limited by the valve body itself blocking the flow, requiring extensive valve lift per cycle. With the limited amount of time available for the valve to be open, there is not enough opening area to achieve a desired volumeteric efficiency during the intake cycle. A complete discussion of this problem is provided in applicant's U.S. patent application Ser. No. 312,871 filed Oct. 19, 1981 now pending, reference to which is herein made.

BRIEF SUMMARY OF THE INVENTION

A poppet valve assembly for use in a four cycle internal combustion engine, each poppet valve assembly being utilized to seal or open relative to a single intake port entering a cylinder chamber. The poppet valve assembly is comprised of a primary poppet valve having one or more apertures moveably connected to a secondary poppet valve also having one or more apertures such that in the closed valve position the primary and secondary valve bodies are sealed when engaged together across the intake port. Each of said primary and secondary poppet valve body apertures are not aligned in the closed position When the valve assembly is in the open postion, the primary and secondary valve bodies are separated such that the apertures permit fluid flow through each valve body, greatly increasing the amount of charge received into the combustion chamber during the intake cycle.

The poppet valve assembly will now be described as to its structure as an intake valve with respect to a single intake port which receives charge through an intake manifold typically found in a four cycle internal combustion engine. The invention described herein can be used for an exhaust valve. The poppet valve assembly is comprised of a primary poppet valve having a valve body and a stem shaped in a conventional manner with the exception that the valve body has one or more apertures. The primary valve stem may be attached in a conventional manner to a valve spring and keeper assembly, and is opened by a cam shaft lobe. A secondary poppet valve body having one or more apertures is moveably mounted over the top of the primary valve body and is connected so as to move reciprocally along the stem of the primary valve while maintaining a seated position through the action of an internal spring disposed about the stem of the primary valve. The primary valve stem includes a longitudinal slot that receives a guide pin attached to the secondary valve body to stop reciprocal movement at a desired point during valve opening and to prevent relative rotational movement between the primary and secondary valve bodies so that the apertures are not aligned.

In the closed valve postion, the upper surface of the primary valve body and the lower surface of the secondary valve body are engaged against each other, the apertures in the primary valve body and the apertures in the secondary valve body being nonaligned so that the primary and secondary valve bodies form a tight seal between apertures when seated across the intake port opening. The secondary valve body has an annular seat disposed about its perimeter that engages the port seat.

Relative to the port seat, during the initial opening of the primary valve, the secondary valve body maintains a mild seat pressure, being delayed in its opening by the secondary valve's internal spring expansion, until the desired time for the secondary valve body to lift off its seat. During the final portion of intake occurrence the secondary valve travels with the primary valve maintaining separation, controlled by the guide pin stop, to an optimum maximum flow position. Therefore, in the open position, the primary and secondary valve bodies are separated, exposing the apertures in both primary and secondary valve bodies to the intake charge during the intake stroke The intake charge accelerates into the combustion chamber not only around the valve assembly perimeter opening formed between the second valve body and the intake port seat but also through the apertures in the primary and secondary valve bodies greatly increasing the volume of charge flow into the combustion chamber during the intake stroke.

Because of the increased available area for the intake charge flow into the combustion chamber, the intake valve assembly in accordance with the invention will function with less valve lift distance if desired. This factor permits extending optimum (maximum) valve opening per unit time of the intake cycle, which results in even a greater volumetric efficiency.

In an alternate embodiment, the reciprocal movement of the secondary valve body away from the primary valve body when the valve assembly is opened by actuation of a cam lobe during the intake cycle can also be rotational to more closely align the primary and secondary valve body apertures during the intake cycle This may be achieved by having a helical slot longitudinally in the primary valve stem and the guide pin connected to the secondary valve and disposed in the slot which then causes the secondary valve to partially rotate during its reciprocal movement away from the primary valve body. (A standard valve rotator on the primary valve is suggested).

The structure described above for the intake valve assembly can be duplicated in the exhaust port also to act as an exhaust valve Thus in a conventional four cycle, internal combustion engine, the valve assembly described herein can be employed in each intake or exhaust port in the engine.

Based on the use of the valve assembly described herein and the apertures disposed therein, the maximum necessary valve lift distance can be reduced greatly so that duration of of the maximum open postion relative to the intake cycle can be extended increasing charge volume. The cam lobe shape permitted by the instant invention greatly reduces the acceleration forces on the valve when it is fully opened compared to conventional valve lift requirement for same.

It is an object of this invention to provide an improved intake valve assembly for use in a four cycle internal combustion engine improving the volumetric efficiency in a naturally aspirated internal combustion engine.

It is another object of this invention to provide an improved exhaust valve assembly for use in a four cycle internal combustion engine that increases the efficiency of removal of exhaust gases during the exhaust cycle of the combustion engine when required It is another object of this invention to provide an improved intake valve assembly for a four cycle internal combustion engine which permits increased duration of the intake valve at optimum valve opening during the important period of high piston velocity of the intake cycle to improve the volumeteric efficiency of the engine.

In accordance with these and other objects which will be apparent hereinafter, the present invention will now be described with particular reference to the accompanying drawings.

PREFERRED EMBODIMENT OF THE INVENTION

Figure 1:
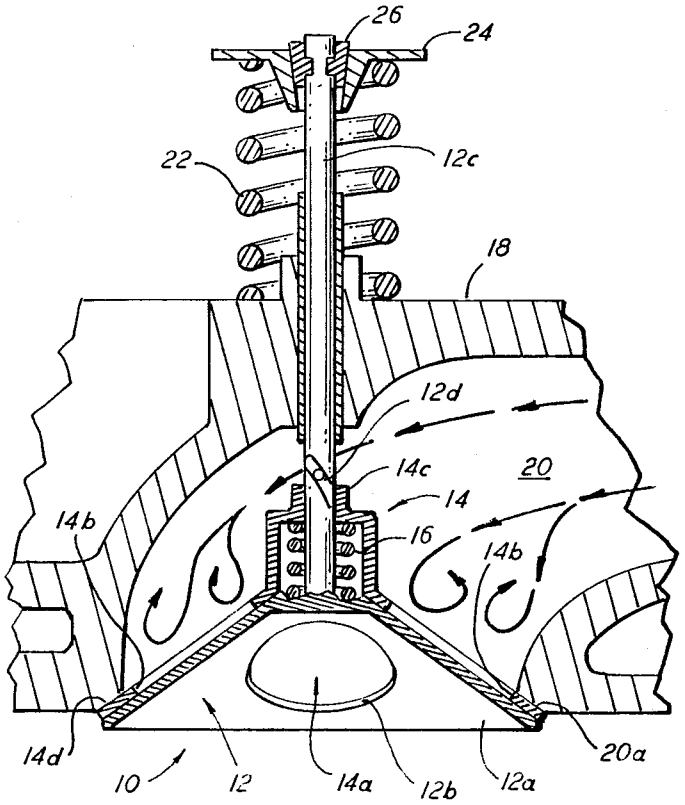
FIG. 1 shows a front cross sectional view of an intake valve assembly constructed in accordance with the present invention showing the intake valve in the closed position relative to the intake port.

Referring now to FIG. 1 of the drawings, the present invention is shown generally at 10 comprised of a poppet valve 12 having apertures **12*b* disposed on opposite sides of a circular valve body 12*a*, a secondary valve 14 having a circular poppet valve body 14*a*, and a pair of apertures 14*b* disposed on opposite sides of valve body 14*a*. FIG. 1 shows an intake valve in a closed position in accordance with the present invention. Intake port 20 includes an annular valve seat 20*a* around its opening. In the closed position, the secondary valve 14 includes a valve seat 14*d*, disposed about the perimeter of its upper surface that engages port valve seat 20*a* The primary valve 12 is seated relative to the secondary valve body 14a about its mating surface. Note that the apertures 14*b* in the secondary valve body and the apertures 12*b*** in the primary valve body are not aligned so that intake charge cannot flow through the apertures when the valve is in the closed position.

The primary valve spring 22 is coupled to the primary valve stem **12*c* using conventional valve spring holders 24 and keepers 26**

Figure 2:
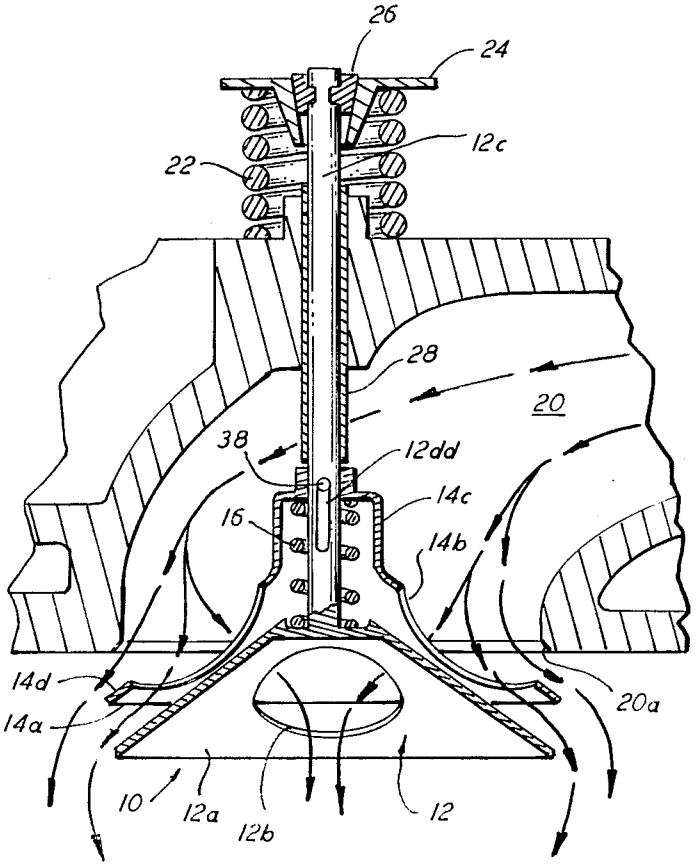
FIG. 2 shows a valve assembly in accordance with an alternate embodiment of the present invention in which the intake valve assembly is disposed in the full open position during the intake cycle.
Figure 3:
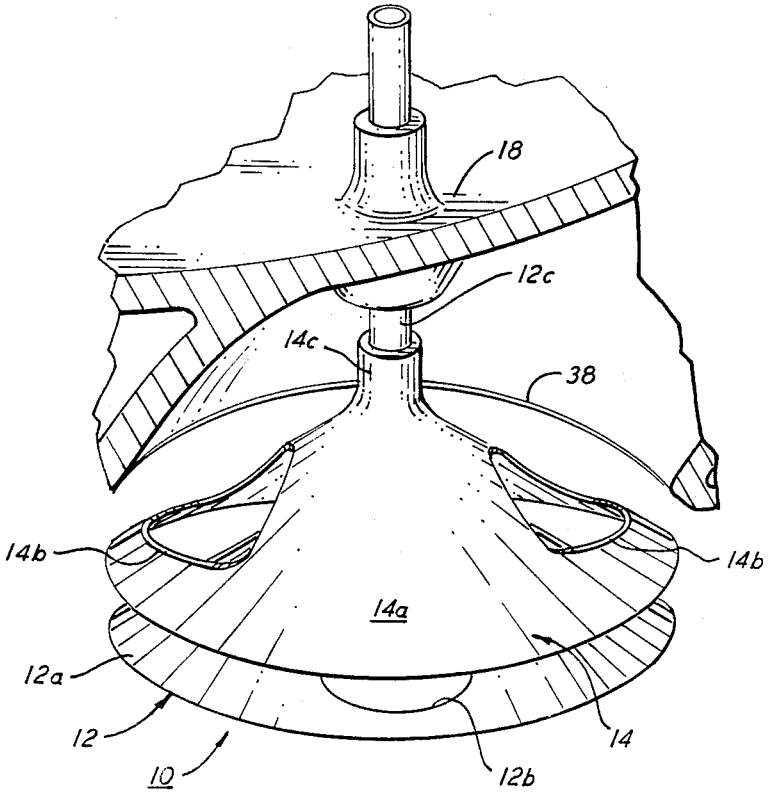
FIG. 3 shows a perspective view of the valve assembly partially cut away in accordance with the present invention.

The secondary valve 14 includes a raised cylindrical housing **14*c* terminating in a circular passage moveably coupled the primary valve stem 12*c*. An internal valve spring 16 about valve stem 12*c* in valve housing 14*c* and engages the primary valve body 12*a*. The secondary valve spring 16 provides a separating spring force between the primary valve body 12*a* and secondary valve body 12*b*. A helically shaped slot 12*d* is disposed within and longitudinally along the outer surface of valve stem 12*c*. The stem slot 12*d* receives a guide pin (not shown in FIG. 1) which causes secondary valve body 14 to rotate during its reciprocal motion when the valve assembly 10 is opened (standard valve rotator not shown) In this embodiment rotation would move apertures 14*b* into closer alignment with apertures 12*b* when the valve is open FIG. 2 shows an alternate embodiment of the intake valve assembly 10 (different slot 12*dd*) in the opened position (the intake cycle) in which the intake charge (direction shown with arrows) is drawn into the cylinder chamber through intake port 20 In the open position shown in FIG. 2, the primary valve stem 12*c* is pushed down by a cam lobe (not shown) forcing the primary valve 12 away from the secondary valve body 14*a*, initially during this transition the secondary valve body 14*a* remains seated permitting charge to flow to the capacity of aperture 14*b*, said seating resulting from relaxation of internal spring 16. Guide pin 38 when contact occurs with the upper end of slot 12*dd* continues in position accelerating with primary valve 12*a* until the full open position shown in FIG. 2 is achieved permitting charge to flow through not only the opening between the secondary valve seat 14*a* and the port valve seat 20*a* but also through apertures 14*b* on opposite sides of the secondary valve body 14*a* and apertures 12*b* on opposite sides of the valve body 12*a*. In the embodiment shown in FIG. 2, the helical slot 12*d* shown in FIG. 1 that causes the secondary valve body 14*a* to rotate slightly relative to the primary valve body 12*a* is changed to a straight longitudinal slot 12*d* which prevents secondary valve body rotation during reciprocal movement to ensure that the apertures 12*b* and 14i b are not aligned or over lapped at any time FIG. 3 shows a perspective view of the valve assembly 10 in accordance with the present invention. The guide pin 38 is disposed through the upper end of secondary valve housing 14*c* and couples the secondary valve body 14*a* to the primary valve stem 12*c* in such a way to cause the rotational motion of the secondary valve body 14*a* in accordance with the discussion of the embodiment of FIG. 1 or to ensure non-rotational, reciprocal motion with respect to the embodiment as shown n FIG. 2**.

Figure 4:
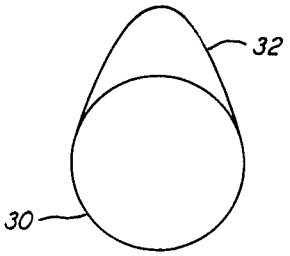
FIG. 4 shows a cross sectional view of a conventional cam lobe.

FIG. 4 shows a standard cam lobe profile with the base circle diameter of the cam shaft 30 and a cam lobe lift profile 32.

Figure 5:
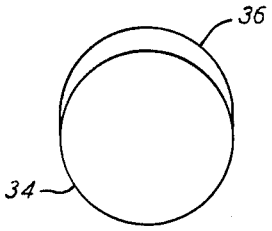
FIG. 5 shows a cross sectional view of a cam lobe of a reduced lift that may be utilized in the present invention.

FIG. 5 shows a cam lobe that may be utilized with the present invention having a lower lift creating longer duration due to the reduction in cam shaft lift distance 36. The present invention allows for optimum air flow in or out of the engine's cylinder which may be achieved at less valve lift as shown by cam lobe 36 having a longer duration than cam lobe 32 in FIG. 4. The extended area or window of opening available to supply the engines cylinder with charge flow induced by the primary and secondary valve body apertures of the instant invention, allow for more charge to flow to the cylinder during the intake cycle than previously achieved in naturally aspirated engines Although each of the embodiments shown has been as an intake valve assembly in a four cycle internal combustion engine, the same valve assembly may be utilized as an exhaust valve or to accomplish comparable valve requirements. The present invention has shown an intake valve assembly that greatly increases the volumetric efficiency in a naturally-aspirated four cycle internal combustion engine.

What I claim is:

1. An intake valve assembly for use in a four cycle internal combustion engine, the valve assembly being disposed in an intake port which opens into a combustion chamber, the valve assembly comprising:

a primary poppet valve in fluid communication with said engine cylinder, said primary poppet valve having a primary valve body and at least one aperture disposed through said primary valve body, and a primary valve stem;

a secondary poppet valve means having a body and a cylindrical stem centrally connected to said body, said secondary valve means moveably mounted on said primary valve stem and shaped to be sealed when engaged with said primary valve body, said secondary valve means body having at least one aperture formed by said secondary valve stem and having at least one aperture in said secondary valve means body disposed therethrough;

means for moving said primary poppet valve to an open position relative to said intake port;

resilient means for moving said secondary poppet valve body away from said primary poppet valve body during said primary poppet valve movement to an open position relative to said port opening; and means for stopping the movement of the secondary poppet valve body during the movement of said primary poppet valve;

whereby when the valve assembly is opening and in the fully open position relative to the intake port, intake charge may flow through the primary and secondary valve body apertures in said valve assembly.

2. A valve assembly as in claim 1, wherein the valve assembly is used as an exhaust valve in a four cycle internal combustion engine

3. A valve assembly as in claim 1, including means connected to said primary poppet valve and said secondary poppet valve body to cause the secondary poppet valve body to rotate relative to the primary poppet valve body whenever the secondary poppet valve body moves reciprocally relative to said primary poppet valve body, said primary and secondary valve body apertures being non-aligned when the valve assembly is in a closed position and more closely aligned when the valve assembly is in an open position due to the rotation of the secondary poppet valve body.

4. An intake valve assembly for a combustion engine cylinder chamber to periodically open and seal an intake port into the cylinder chamber comprising:

a first poppet valve having a valve body with at least one aperture and a valve stem;

a second poppet valve having a disc-shaped body with at least one body aperture and one mounting aperture and a mounting means centrally located for mounting said second poppet valve on said first poppet valve stem, permitting reciprocal movement thereon;

means for opening and closing said valve assembly; and means for separating said first poppet valve body and said second poppet valve body when the valve assembly is in the open position.

* * * * *